US005987955A

United States Patent [19]

Benner

[11] Patent Number: 5,987,955

[45] Date of Patent: Nov. 23, 1999

[54] METHOD OF OPERATING A COIL TRANSFER APPARATUS AND A CORRESPONDING COIL TRANSFER APPARATUS

[75] Inventor: Frank Benner, Hilchenbach, Germany

[73] Assignee: SMS Schloemann-Siemag Aktiengesellschaft, Düsseldorf, Germany

[21] Appl. No.: 09/232,512

[22] Filed: Jan. 15, 1999

[30] Foreign Application Priority Data

Jan. 28, 1998 [DE] Germany ..... 198 03 091

[51] Int. Cl.[6] ..... B21B 39/20

[52] U.S. Cl. ..... 72/250; 242/533.2; 242/538

[58] Field of Search ..... 72/142, 146, 148, 72/170, 172, 205, 250, 419, 426; 242/533, 533.2, 538, 538.2

[56] References Cited

U.S. PATENT DOCUMENTS 4,096,724 6/1978 Eshelman et al. ..... 72/146

4,306,438 12/1981 Child et al. ..... 72/146

5,673,869 10/1997 Honegger ..... 242/528

OTHER PUBLICATIONS

Stahl and Eisen 103 (1983), No. 7, pp. 31 to 36.

*Primary Examiner*—Rodney Butler

*Attorney, Agent, or Firm*—Friedrich Kueffner

[57] ABSTRACT

A method of operating a coil transfer apparatus and a coil transfer apparatus with a coiling station having a coiling roller each at an entry side and an exit side and with a uncoiling station with an uncoiling roller each on an entry side and an exit side. The method includes coiling a strip in a coiling station into a coil or placing a coil onto the coiling rollers, supporting the coil by the coiling rollers during coiling or after placement of the coil on the coiling rollers, and transferring the coil for uncoiling to the uncoiling station and supporting the coil after the transfer during uncoiling by the uncoiling rollers. The method further includes the steps of moving the coiling and uncoiling stations toward each other and raising the coiling roller on the entry side of the coiling station.

8 Claims, 2 Drawing Sheets

10
3
4
5
6

METHOD OF OPERATING A COIL TRANSFER APPARATUS AND A CORRESPONDING COIL TRANSFER APPARATUS

BACKGROUND OF THE INVENTION

1. Field of the Invention

The present invention relates to a method of operating a coil transfer apparatus with a coiling station having a coiling roller each at an entry side of the coiling station and an exit side of the coiling station and with a uncoiling station with an uncoiling roller each on an entry side of the uncoiling station and an exit side of the uncoiling station. The method includes coiling a strip in a coiling station into a coil or placing a coil onto the coiling rollers, supporting the coil by the coiling rollers during coiling or after placement of the coil on the coiling rollers, and transferring the coil for uncoiling to the uncoiling station and supporting the coil after the transfer during uncoiling by the uncoiling rollers.

The present invention also relates to a corresponding coil transfer apparatus.

2. Description of the Related Art

Slabs are either continuously cast in thin slab casting machines to dimensions which are close to the final dimensions or they are rolled after continuous casting in a roughing train before they are further processed in a finishing train. The strip leaves the roughing train approximately at three times the speed at which it is later to enter into the finishing train. Therefore, in order to maintain the temperature of the slab, the prior art provides that, for example, as disclosed in Stahl und Eisen 103 (1983) No. 7, pages 31 to 36, that the slab is coiled into a coil in a coiling station of a coil transfer apparatus, wherein the coil is supported by coiling rollers during coiling. Subsequently a mandrel is moved into the eye of the coil and the coil is transferred from the coiling station to the uncoiling station.

Uncoiling of the strip is started already when the mandrel is moved into the eye and the coil is transferred. Coiling of the next strip into a coil can start as soon as the already coiled coil has reached the uncoiling station.

Because the mandrel is moved into the eye of the coil, the inner windings are cooled to a greater extent than the outer windings; this has a negative influence on the rolling process in the finishing train and the quality of the finish-rolled strip.

Methods of operating coil transfer apparatuses and corresponding coil transfer apparatuses, in which the transfer of the coil occurs without a mandrel, are already known in the art. However, all of these methods and apparatuses are complicated and expensive. Also, the apparatuses are not easily accessible for maintenance and repair work.

SUMMARY OF THE INVENTION

Therefore, it is the primary object of the present invention to provide a method of operating a coil transfer apparatus and a corresponding coil transfer apparatus which make it possible in a simple and inexpensive manner to carry out a safe transfer of the coils without a mandrel from the coiling station to the uncoiling station.

In accordance with the present invention, for transferring the coil, the method includes the steps of moving the coiling and uncoiling stations toward each other and raising the coiling roller on the entry side of the coiling station.

The corresponding coil transfer apparatus includes means for moving the coiling and uncoiling stations towards each other and for raising the coiling roller on the entry side of the coiling station.

When the uncoiling roller on the entry side of the uncoiling station is raised or lowered prior to or during the transfer, i.e., this uncoiling roller is raisable or lowerable, a trough is formed between the coiling stations in which the coil can rest during the transfer.

If after the transfer and for completing the transfer the coiling roller on the exit side of the coiling station is raised, i.e., this roller is also raisable, it is completely ensured in a simple manner that a complete transfer of the coil to the uncoiling station takes place.

The structural requirements for realizing the coil transfer apparatus is particularly simple when the coiling station is horizontally rigid or stationary and the uncoiling station is horizontally moveable.

The raisability of the two coiling rollers is structurally particularly simple if the coiling rollers are mounted in frames having an entry side and an exit side and one of the frames is tiltable relative to the coiling station about the end of the frame on the exit side of the frame.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
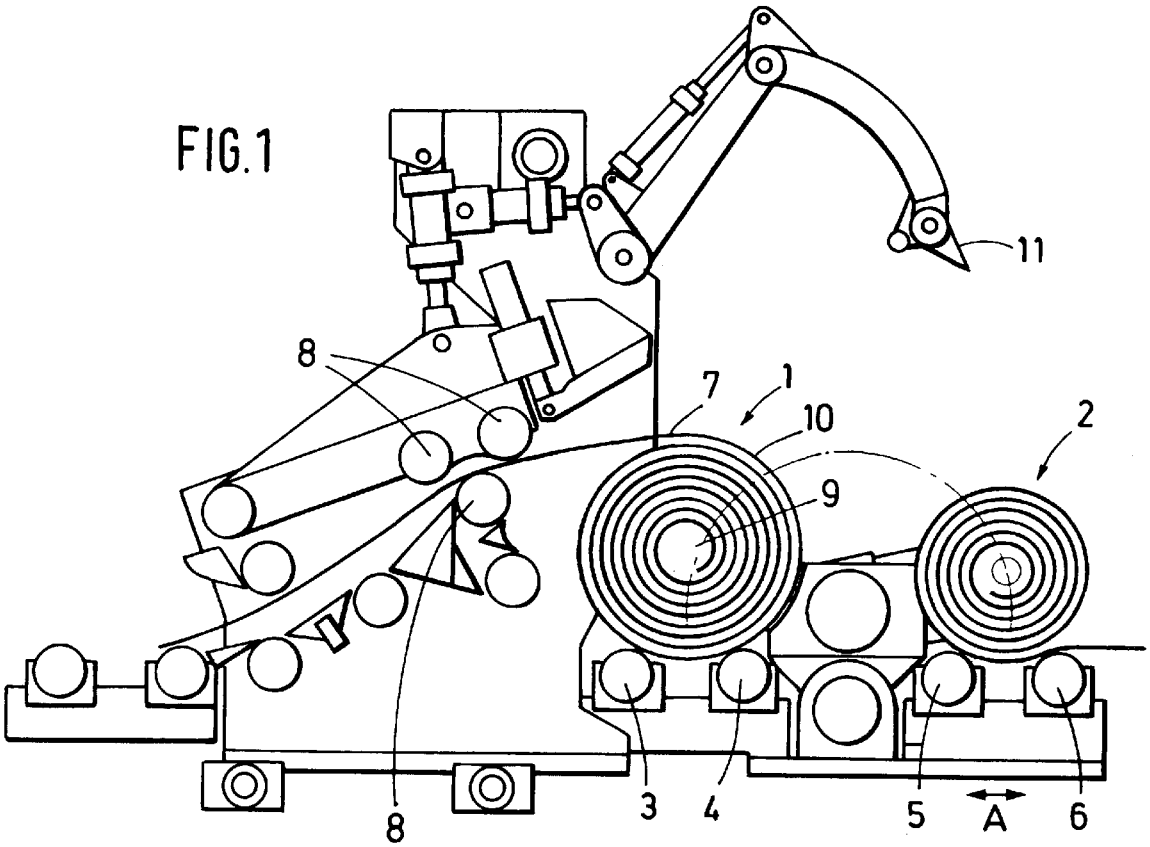
FIG. 1 is a schematic elevational view of a coil transfer apparatus.

As illustrated in FIG. 1, a coil transfer apparatus includes a coiling station 1 and an uncoiling station 2. The coiling station 1 includes a coiling roller 3 on the entry side of the coiling station and a coiling roller 4 on the exit side of the coiling station. The uncoiling station 2 includes an uncoiling roller 5 on the entry side of the uncoiling station and an uncoiling roller 6 on the exit side of the uncoiling station.

The coil transfer apparatus in accordance with the illustrated embodiment operates as follows:

A preliminary strip 7, for example, arriving from a roughing stand, is supplied through guiding and bending rollers 8 to the coiling station 1. In the coiling station 1, the strip is coiled into a coil 10 without a mandrel, i.e., with an open eye 9. During coiling, the coil 10 is supported and rotated by the driven coiling rollers 3, 4.

When the preliminary strip 7 is completely coiled, the coil opener 11 is placed on the coil 10 and uncoiling of the coil 10 is started while the coil is still in the coiling station 1. During the beginning of the uncoiling procedure, the coil 10 is then transferred to the uncoiling station 2. After the transfer, the coil 10 is supported by the uncoiling rollers 5, 6. The actual transfer procedure will now be described in the following in connection with FIGS. 2*a*–2*d*.

Figures 2A, 2B, 2C, 2D:
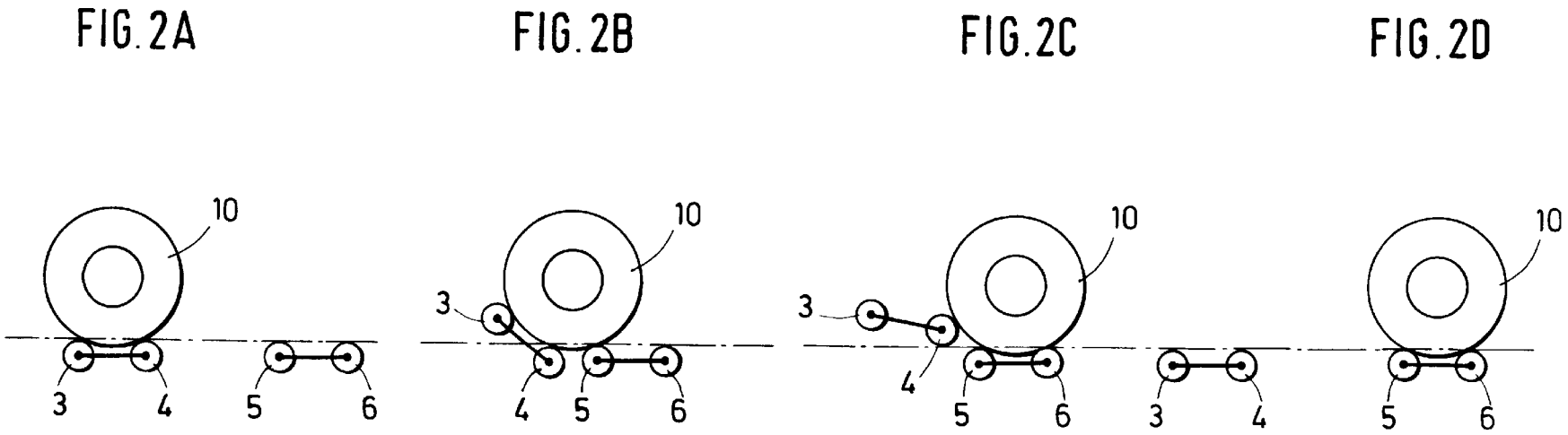
FIGS. 2*a*–2*d* show various stages of the transfer procedure.

FIG. 2*a* shows the positions of the coiling rollers 3 to 6 prior to the beginning of the transfer procedure. At this point in time the coil 10 is still supported by the coiling rollers 3, 4.

As shown in FIG. 2*b*, at the beginning of the transfer procedure the coiling roller 3 at the entry side of the coiling station is raised and the coiling stations 1, 2 are moved toward each other. If necessary, the uncoiling roller 5 on the entry side of the uncoiling station can be slightly raised. This produces between the coiling roller 4 on the exit side of the coiling station and the uncoiling roller 5 on the entry side of the uncoiling station a trough in which the coil 10 can rest for a short period of time.

Subsequently, as illustrated in FIG. 2*c*, for completing the transfer of the coil 10, the coiling roller 4 on the exit side of the coiling station is raised, so that the coil 10 is securely supported on the uncoiling rollers 5, 6.

Finally, as shown in FIG. 2*d*, the coiling and uncoiling stations are once again moved apart from each other and the transfer procedure is now concluded. At this point in time, the coil 10 is exclusively supported by the uncoiling rollers 5, 6.

The coiling rollers 3 through 6 and, thus, also the coil 10 rotate during the entire uncoiling and transfer procedure. Even after the transfer has been completed, the uncoiling rollers 5, 6 rotate the coil 10. However, since this coil 10 is now uncoiled without a mandrel, the last winding must be held down with suitable means in order to ensure that the preliminary strip 7 enters the finishing train without problems. This can be effected, for example, by means of the coil opener 11. Alternatively, it is also possible to use a holding-back roller or a holding-back pin.

It is apparent from the description provided above that the coiling and uncoiling stations 1, 2 can be moved toward each other and the two coiling rollers 3, 4 and possibly also the uncoiling roller 5 on the entry side of the uncoiling station can be raised. In accordance with a preferred feature, the coiling station 1 is stationary in the horizontal direction and the uncoiling station 2 can be moved horizontally toward and away from the coiling station 1, so that not too many degrees of freedom have to be realized in a coiling or uncoiling station 1, 2. This is indicated in FIG. 1 by a double arrow A. The horizontal movement of the uncoiling station 2 can be effected by moving means, for example, hydraulically or by means of an electric motor.

Figure 3:
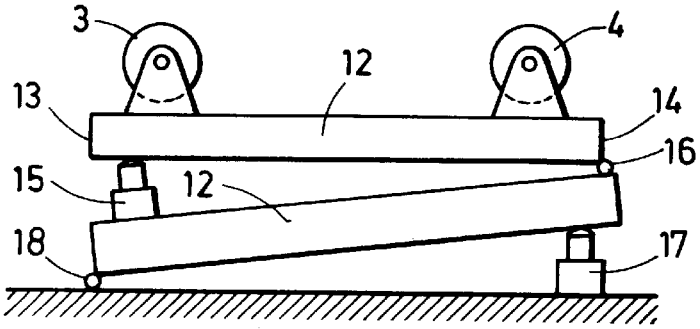
FIG. 3 is an elevational view, on a larger scale, of the coiling station.

FIG. 3 of the drawing shows the simplest possibility for realizing the raisability of the two coiling rollers 3, 4. As shown in FIG. 3, the coiling rollers 3, 4 are mounted in frames 12 which have an end 13 on the entry side of the frame 12 and an end 14 on the exit side of the frame 12. One of the frames 12 can be pivoted, for example, by means of a hydraulic cylinder 15 arranged in the vicinity of the end 13 on the entry side of the frame 12, about an axis 16 located at the end 14 on the exit sidie of the frame 12. The other frame 12 can be pivoted, for example, by another hydraulic cylinder 17 about another axis 18. As a result, the two coiling rollers 3, 4 can be raised and lowered in a structurally simple manner, wherein simultaneously the distance between the coiling rollers 3, 4 can be safely kept constant.

Finally, it should be mentioned that it is of course also possible to raise and lower the coiling station 1 by a coordinated adjustment of the hydraulic cylinders 15, 17. If desired or necessary, it is of course also possible to construct, the uncoiling station 2 so as to be raisable and lowerable, for example, by means of hydraulic cylinders.

While specific embodiments of the invention have been shown and described in detail to illustrate the inventive principles, it will be understood that the invention may be embodied otherwise without departing from such principles.

I claim:

1. In a method of operating a coil transfer apparatus including a coiling station with a coiling roller each on an entry side of the coiling station and an exit side of the coiling station, and an uncoiling station with an uncoiling roller each on an entry side of the uncoiling station and an exit side of the uncoiling station, the method including the steps of coiling strip in the coiling station to form a coil or placing a coil onto the coiling rollers, supporting the coil by the coiling rollers during coiling or after placement of the coil thereon, and transferring the coil to the uncoiling station for uncoiling the coil and supporting the coil on the uncoiling rollers during uncoiling after the transfer, wherein the improvement comprises moving the coiling and uncoiling stations toward each other for transferring the coil and raising the coiling roller on the entry side of the coiling station.

2. The method according to claim 1, comprising one of raising and lowering the uncoiling roller on the entry side of the uncoiling station prior to or during the transfer.

3. The method according to claim 1, comprising raising the coiling roller on the exit side of the coiling station after the transfer for completing the transfer.

4. A coil transfer apparatus comprising a coiling station with a coiling roller each on an entry side of the coiling station and an exit side of the coiling station, and an uncoiling station with an uncoiling roller each on an entry side of the uncoiling station and an exit side of the uncoiling station, further comprising means for moving the coiling and uncoiling station toward each other and means for raising the coiling roller on the entry side of the coiling station.

5. The coil transfer apparatus according to claim 4, wherein the coiling station is mounted so as to be stationary in a horizontal direction, and wherein the means for moving the coiling and uncoiling stations toward each other is configured to move the uncoiling station in the horizontal direction.

6. The coil transfer apparatus according to claim 4, comprising means for one of raising and lowering the uncoiling roller on the entry side of the uncoiling station.

7. The coil transfer apparatus according to claim 4, comprising frames each having an end on an entry side of the frame and an end on the exit side of the frame, the coiling rollers being mounted on the frames, wherein one of the frames is mounted so as to be tiltable relative to the coiling station about the end of the frame on the exit side of the frame.

8. The coil transfer apparatus according to claim 4, comprising means for raising the coiling roller on the exit side of the coiling station.

* * * * *